US011299853B2

(12) United States Patent
Hoglund et al.

(10) Patent No.: US 11,299,853 B2
(45) Date of Patent: Apr. 12, 2022

(54) PAPER OR PAPERBOARD PRODUCT COMPRISING AT LEAST ONE PLY CONTAINING HIGH YIELD PULP AND ITS PRODUCTION METHOD

(71) Applicants: Hans Hoglund, Matfors (SE); Gunilla Pettersson, Sundsvall (SE); Sven Norgren, Sundsvall (SE); Per Engstrand, Aby (SE)

(72) Inventors: Hans Hoglund, Matfors (SE); Gunilla Pettersson, Sundsvall (SE); Sven Norgren, Sundsvall (SE); Per Engstrand, Aby (SE)

( * ) Notice: Subject to any disclaimer, the term of this patent is extended or adjusted under 35 U.S.C. 154(b) by 0 days.

(21) Appl. No.: 16/334,371

(22) PCT Filed: Sep. 20, 2017

(86) PCT No.: PCT/EP2017/073745
§ 371 (c)(1),
(2) Date: Mar. 19, 2019

(87) PCT Pub. No.: WO2018/054957
PCT Pub. Date: Mar. 29, 2018

(65) Prior Publication Data

US 2019/0218716 A1 Jul. 18, 2019

(30) Foreign Application Priority Data

Sep. 21, 2016 (SE) ..... 1630229-1

(51) Int. Cl.
*D21F 3/02* (2006.01)
*D21H 11/02* (2006.01)
(Continued)

(52) U.S. Cl.
CPC ..... *D21F 3/0281* (2013.01); *D21H 11/02* (2013.01); *D21H 11/08* (2013.01); *D21H 11/10* (2013.01)

(58) Field of Classification Search
CPC ..... D21H 11/08; D21H 11/10; D21H 11/02; D21H 27/30; D21H 27/38; D21F 11/00;
(Continued)

(56) References Cited

U.S. PATENT DOCUMENTS 4,391,670 A 7/1983 Phillips
4,455,237 A * 6/1984 Kinsley ..... D21H 11/08 210/767

(Continued)

FOREIGN PATENT DOCUMENTS

CA 3036442 A1 * 3/2018 ..... D21H 11/08
EP 0 219 643 A1 4/1987

(Continued)

OTHER PUBLICATIONS

Back, E.L., and Salmen, N.L., "Glass transitions of wood components hold implications for molding and pulping processes," TAPPI, vol. 65, No. 7, pp. 107-110 (1982).

(Continued)

*Primary Examiner* — Jose A Fortuna
(74) *Attorney, Agent, or Firm* — Schott, P.C.

(57) ABSTRACT

A method of producing a paper or paperboard product having at least one ply comprising high yield pulp (HYP), comprising the steps of: —providing a furnish comprising at least 50% of high yield pulp (HYP) of a total pulp content in said furnish, said high yield pulp being produced with a wood yield above 85%; —dewatering the furnish to form a moist web and pressing said moist web to a dry solids content of at least 40-70%; and —densifying the moist web to a density above 600 kg/m3 in a press nip of a paper
(Continued)

machine at a temperature above a softening temperature of water-saturated lignin comprised in said high yield pulp to provide a paper or paperboard product, containing at least 30% high yield pulp (HYP) of a total pulp content of said product.

16 Claims, 6 Drawing Sheets

(51) Int. Cl.
*D21H 11/08* (2006.01)
*D21H 11/10* (2006.01)

(58) Field of Classification Search
CPC . D21F 3/0281; D21F 5/00; D21F 3/02; D21F 9/00; B32B 29/00
See application file for complete search history.

(56) References Cited

U.S. PATENT DOCUMENTS

| | | | | | |
|---|---|---|---|---|---|
| 4,461,095 | A | | 7/1984 | Lehtinen | |
| 4,718,981 | A | * | 1/1988 | Swenson | D21F 11/00 162/100 |
| 4,718,982 | A | * | 1/1988 | Swenson | D21F 11/00 162/142 |
| 4,818,342 | A | * | 4/1989 | Wagle | D21F 11/00 162/207 |
| 4,836,892 | A | * | 6/1989 | Edwards | D21C 9/00 162/141 |
| 5,080,758 | A | * | 1/1992 | Horng | B32B 29/00 162/130 |
| 5,867,919 | A | | 2/1999 | Retulainen | |
| 5,879,510 | A | * | 3/1999 | Hagglund | D21B 1/12 162/25 |
| 6,322,667 | B1 | | 11/2001 | McCall et al. | |
| 6,458,245 | B1 | * | 10/2002 | Hoglund | B27N 1/00 162/149 |
| 6,616,807 | B1 | * | 9/2003 | Dyllick-Brenzinger | D21H 21/10 162/164.6 |
| 7,294,239 | B2 | | 11/2007 | Lomic et al. | |
| 8,142,615 | B2 | | 3/2012 | Wildlock et al. | |
| 8,454,799 | B2 | * | 6/2013 | Jehn-Rendu | D21C 9/005 162/202 |
| 10,145,068 | B2 | * | 12/2018 | Hans | D21H 11/10 |
| 10,364,533 | B2 | * | 7/2019 | Heiskanen | D21H 27/30 |
| 2002/0062938 | A1 | | 5/2002 | Westman et al. | |
| 2004/0231811 | A1 | * | 11/2004 | Engstrand | D21B 1/16 162/25 |
| 2008/0023164 | A1 | * | 1/2008 | Fredlund | D21H 11/20 162/164.2 |
| 2011/0290434 | A1 | * | 12/2011 | Jehn-Rendu | D21H 11/20 162/4 |
| 2017/0051456 | A1 | * | 2/2017 | Hans | D21H 21/18 |
| 2019/0218716 | A1 | * | 7/2019 | Hoglund | D21H 11/10 |
| 2021/0238808 | A1 | * | 8/2021 | Tirimacco | B32B 7/02 |

FOREIGN PATENT DOCUMENTS

| | | | | | |
|---|---|---|---|---|---|
| EP | 02196426 | A1 | | 4/1987 | |
| EP | 0219643 | B1 | * | 1/1991 | D21F 11/00 |
| EP | 0219643 | B1 | | 1/1991 | |
| FI | 54514 | B | | 8/1978 | |
| RU | 2428535 | C2 | | 9/2011 | |
| WO | 94/16139 | A1 | | 7/1994 | |
| WO | WO-0225013 | A1 | * | 3/2002 | D21H 21/52 |
| WO | WO-2006041401 | A1 | * | 4/2006 | D21H 11/20 |
| WO | 2015/036932 | A1 | | 3/2015 | |
| WO | 2015/166426 | A1 | | 11/2015 | |
| WO | 2015166426 | A1 | | 11/2015 | |

OTHER PUBLICATIONS

Rvine, G.M., "The significance of the glass transition of lignin in thermomechanical pulping," Wood Science and Technology, vol. 19, pp. 139-149 (1985).
Klinga, N., et al., "Energy efficient high quality CTMP for paperboard," Journal of Pulp and Paper Science, vol. 34, No. 2, pp. 98-106 (2008).
Pettersson, G., et al., "Strong and bulky paperboard sheets from surface modified CTMP, manufactured at low energy," Nordic Pulp & Paper Research Journal, vol. 30, No. 2, pp. 319-325 (2015).
Pettersson, G., et al., "The use of polyelectrolyte multilayers of cationic starch and CMC to enhance strength properties of papers formed from mixtures of unbleached chemical pulp and CTMP Part II," Nordic Pulp&Paper Research Journal, vol. 21, No. 1, pp. 122-128 (2006).
Pettersson, G., et al., "The use of polyelectrolyte multilayers of cationic starch and CMC to enhance strength properties of papers formed from mixtures of unbleached chemical pulp and CTMP, Part I," Nordic Pulp&Paper Research Journal, vol. 21, No. 1, pp. 115-121(2006).
Pynnonen, T. et al., "Good bonding for low-energy HT-CTMP by press drying," Pulp & Paper Canada, vol. 105, No. 3, pp. 33-37 (2004).
International Search Report and Written Opinion of International Searching Authority for PCT Application No. PCT/EP2017/073745 dated Nov. 17, 2017.
Search Report issued in corresponding Russian Application No. 2019108182/05 filed Sep. 20, 2017, 2 pages.
Examination Request issued in corresponding Russian Application No. 2019108182/05 dated Sep. 8, 2020, 5 pages.
Translation of Examination Request issued in corresponding Russian Application No. 2019108182/05 dated Sep. 8, 2020, 1 page.
Office action in related JP application 2017800582428 dated Dec. 22, 2020.
Communication Pursuant to Article 94(3) EPC Issued from the European Patent Office within the European Application No. 17771425.0-1102, dated Jun. 17, 2021, 7 pages.
Notification of Second Office Action Issued from China National Intellectual Property Administration within the Chinese Application No. 2017800582428, dated Apr. 27, 2021, 8 pages.
Translation of Notification of Second Office Action Issued from China National Intellectual Property Administration within the Chinese Application No. 2017800582428, dated Apr. 27, 2021, 8 pages.
Chinese Office Action Issued from the Chinese Intellectual Property Office within the Chinese Patent Application No. 2017800582428, dated Oct. 19, 2021, 6 pages.
English Translation and Summary of Chinese Office Action Issued from the Chinese Intellectual Property Office within the Chinese Patent Application No. 2017800582428, dated Oct. 19, 2021, 3 pages.
First Examination Report Issued from Intellectual Property Government of India within the Indian Application No. 201917008608, dated Jul. 12, 2021, 5 pages.

* cited by examiner

PAPER OR PAPERBOARD PRODUCT COMPRISING AT LEAST ONE PLY CONTAINING HIGH YIELD PULP AND ITS PRODUCTION METHOD

TECHNICAL FIELD

The present invention relates to a method of producing a paper or paperboard product having at least one ply containing high yield pulp, and to a paper or paperboard product comprising at least one ply containing high yield pulp.

BACKGROUND ART

In the production of High Yield Pulps (HYP), single fibers are separated from the wood raw material as a result of mechanical treatments of chips in disc refiners or of logs in wood grinders after softening of the wood lignin at enhanced temperature and/or with chemical pretreatments (Sundholm, J. (1999): "What is mechanical pulping" in Mechanical pulping, Volume 5 of Papermaking science and technology, ed. Gullichsen, J. and Paulapuro, H., 199, Helsinki: Finnish Paper Engineer's Association, p 17-21). The wood yield in these types of pulping processes (e.g. thermomechanical (TMP), chemi-thermomechanical (CTMP), high temperature chemi-thermomechanical (HTCTMP), chemimechanical (CMP), stone groundwood (SGW) and pressure groundwood (PGW) processes) is high, typically over 90% (Sundholm, J. (1999), above). To make fibers from these processes suitable for papermaking, their structures are generally loosened up by energy demanding mechanical treatments in the pulping processes, to improve the flexibility of the separated originally very stiff fiber material. To reach this goal, fibers are delaminated and so-called fines are peeled off from the outer layers of the fibers. Ideally, the surfaces of the remaining fibers will be well fibrillated. Up until to now HYP, has primarily been used in the production of two types of products: graphic paper and paperboard.

Mechanical pulps for graphic papers (news and magazine papers) are characterized by a high light scattering ability at certain sheet strength. To manufacture pulp with a high light scattering coefficient, a lot of fines from the outer fiber layers have to be produced in the chip refiners or wood grinders, which means that the energy consumption in the production of these types of HYP qualities is very high (Sundholm, J. (1993): Can we reduce energy consumption in mechanical pulping?, International Mechanical Pulping Conference, Oslo, Norway, June 15-17, Technical Association of the Norwegian Pulp and Paper Industry, Oslo, Norway, 133-42). The conditions necessary for manufacturing pulps with high light scattering ability are deteriorated if wood lignin is softened to a too great extent in wood pretreatments during HYP processing or in the papermaking process (Atack, D. (1972): On the characterization of pressurized mechanical pulps, Svensk Papperstidning 75,89). At efficient softening of lignin within the fiber walls, fiber flexibility can certainly be improved in papermaking, which increases the fiber-fiber bond areas in the sheet structure and the overall strength. However, improved sheet strength is achieved on the expense of light scattering ability (opacity) and sheet bulk, which is not desired in production of HYP for graphic papers products. Therefore, the positive effect of lignin softening at enhanced temperatures is rarely used in the manufacturing of HYP containing papers to be used in high quality graphic papers.

In the manufacturing of HYP for paperboard products, where a high sheet bulk at certain strength levels is required, the high stiffness of HYP fibers compared to chemical pulp fibers, can be used. Manufacturing of such HYP qualities is less energy demanding than the manufacturing of HYP for graphic papers, as light scattering, i.e. creation of fines, is of minor importance. In multi-ply paperboard products, the bending stiffness is improved significantly when the materials are designed to have outer plies with a high tensile strength and tensile stiffness combined with a bulky middle ply based on stiff HYP fibers as a main component (Fellers, C., deRuvo, A., Htun, M., Calsson, L., Engman, C. and Lundberg, R. (1983): In Carton Board, Swedish Forest Products Research Laboratory, Stockholm, Sweden; Fineman, I. (1985): "Let the paper product guide the choice of mechanical pulp", Proceedings from International Mechanical Pulping Conference, Stockholm, p 203-214; Tomas, H. (1997): Mechanical pulp in paperboard packaging, Proceedings from 1997 International Mechanical Pulping Conference, Stockholm, p 9-15; and Bengtsson, G. (2005): CTMP in production of high quality packaging board, Proceedings from International Mechanical Pulping Conference, Oslo p 7-13 (2005), for example.).

At a given in-plane or out-of-plane strength, HYP can be formed into sheets with significantly higher sheet bulk than sheets from kraft pulps (Fineman, Tomas, and Bengtsson, all three above, and Höglund, H. (2002): Mechanical pulp fibers for new and improved paper grades, Proceedings from $7^{th}$ International Conference on new available technology, Stockholm, p 158-163, for example). Both in-plane and out-of-plane strength of bulky sheets based on stiff HYP fibers can be further improved by surface modification of the fiber surfaces, e.g. by adding mixtures of cationic starch and CMC (Pettersson, G., Höglund, H. and Wågberg, L. (2006): The use of polyelectrolyte multilayers of cationic starch and CMC to enhance strength properties of papers formed from mixtures of unbleached chemical pulp and CTMP Part I and II, Nordic Pulp&Paper Research Journal 21(1), p 115-128; Pettersson, G., Höglund, H., Sjoberg, J., Peng, F., Bergström, J., Solberg, D., Norgren, S., Hallgren, H., Moberg, A. and Ljungqvist, C-H. (2015): Strong and bulky paperboard sheets from surface modified CTMP, manufactured at low energy, Nordic Pulp&Paper Research Journal, 30(2), 318-324; and Hallgren, H., Peng, F., Moberg, A., Höglund, H., Pettersson, G. and Norgren, S. (2015): Process for production of at least one ply of paper or board and a paper or board produced according to the process, WO 2015/166426 A1, for example.). The improved strength from such surface treatment can be achieved at a maintained high sheet bulk as long as the fiber stiffness is preserved. However, if the fiber walls are softened at elevated temperatures at consolidation of the paper structure, such as in hot press drying operations, sheet strength improvement is achieved on the expense of reduced sheet bulk (Nygren, O., Bäck, R. and Höglund, H. (2003): On characterization of Mechanical and Chemimechanical Pulps. International Mechanical Pulping, Proceedings, Quebec City, Canada, p 97-104). Consequently, softening of fiber walls in papermaking processes at manufacturing of paperboard products is not favorable. However, efficient softening of wood lignin at temperatures well above the softening temperature of water-saturated lignin can be used in the manufacturing of HYP to get very low shive content at low energy input in the refining stage, and from which it is advantageous to make sheets characterized by a very high bulk (the two Höglund papers above; and Höglund, H., Bäck, R., Danielsson, O. and Falk, B. (1994): A method of producing mechanical and chemimechanical pulp, WO 94/16139 A1, for example). The softening temperature of water-saturated lignin is generally somewhat higher for softwoods than for hardwoods (Olsson, A-M, Salmén, N. L. (1992): Viscoelasticity of in situ lignin as affected by structure. Softwood vs. Hardwood. 1992 American Chemical Society, Chapter 9, p 134-143) and is affected of several processing conditions in pulp and papermaking unit processes like loading frequencies in grinders and refiners as well as loading rates in press nips of paper-machines (Irvine, G. M. (1985): The significance of glass transition of lignin in thermomechanical pulping. Wood Science and Technology, 19, 139-149). The softening temperature of water-saturated lignin can also be changed, typically lowered, by chemical treatments of the fiber walls (Atack, D and Heitner, C. (1997): Dynamic mechanical properties of sulphonated eastern black spruce. Trans. of Technical Section CPPA 5(4): TR99) and is consequently altered in CTMP, HTCTMP and CMP processes. In native lignin the softening effect has a limit at water contents as low as 5%, when the lignin is water-saturated. Additional water does not result in a considerable further softening of the native lignin or change of the softening temperature (Back, E. L. and Salmén, N. L. (1982): Glass transition of wood components hold implication for molding and pulping processes, TAPPI, 65(7), 107-110). At processing in CTMP, HTCTMP and CMP processes, where the lignin becomes chemically modified, water-saturation occurs at somewhat higher water content than in native lignin.

HYP is not commonly used in paper grades with very high requirements on dry and wet strength, e.g. packaging papers, paper bags, liner or fluting. Papers with very high strength based on pulps from CTMP and CMP processes can certainly be manufactured under conventional papermaking conditions (Höglund, H. and Bodin, O. (1976): Modified thermo-mechanical pulp, Svensk Papperstidning 79(11), p 343-347), but to achieve that the fiber material has to be refined to very high flexibility to get high density and strength, which is extremely energy demanding (Klinga, N., Höglund, H. and Sandberg, C. (2008): Energy efficient high quality CTMP for paperboard, Journal of Pulp and Paper Science 34(2), p 98-106). The energy consumption is on such high level that up until now, there has been little interest in using HYP in paper products with very high requirements on strength for economic reasons.

In a hot press of a papermaking machine, where a moist paper or paperboard web containing HYP is subjected to high pressure at a temperature that may rise above the softening temperature of water-saturated lignin, the lignin is changed, i.e. becomes tacky (Gupta, P. R., Pezanowich, A. and Goring, D. (1962): The Adhesive Properties of Lignin, 63(1), T21-31; and Goring, D. (1963): Thermal Softening of Lignin, Hemicellulose and Cellulose, Pulp and Paper Magazine of Canada, 64(12), T517-T527, for example). This will result in amplified densification of the paper web and enhanced fiber-fiber bond strength at both final dry and wet conditions in sheet structures. In pressing of sheets from chemical pulps with low contents of lignin at equivalent conditions this enhance in bond strength is not that remarkable. However, if the press-drying stage is carried out at too low dry content, namely much lower than at the dry content where the fiber wall is saturated with water the strength of fiber-fiber bonds are not enhanced and compressed stiff fibers easily spring back to their original shape when the pressure is released, since creation of permanent fiber-fiber bonds are prevented by the water between fiber surfaces in the paper sheet (Norgren, S., Pettersson, G. and Höglund, H. (2014): High strength papers from high yield pulps, Paper Technology 56(5), p 10-14). The fiber walls in HYP fibers are saturated with water at about 75% dry content. However, if the dry content is too high, i.e. much above the wet fiber saturation point of the fiber material, permanent fiber-fiber bonds with high strength cannot be established in any wood fiber based paper structures.

Fiber-fiber bond strength in paper sheets is usually measured in a Scott Bond apparatus and reported as a Scott-Bond strength value according to a TAPPI method. HYP sheets that are manufactured in conventional papermaking have usually Scott Bond strength below 400 J/m$^2$ even though HYP fibers have been refined to high flexible at very high energy inputs to be a high quality fiber in printing paper grades (Sundholm, J., Book 5 of Papermaking Science and Technology (1999), ISBN 952-5216-05-5, p 400).

SUMMARY OF THE INVENTION

The objects of the present invention are to make it possible to reduce the energy consumption in the production of HYP containing paper and paperboard products with very high requirements on strength, as HYP that is manufactured with low energy consumption in chip refining or wood grinding can be used, as well as making it possible to manufacture paper and paperboard products with very high dry strength, wet strength, compression strength as well as tensile stiffness based on such HYPs.

In a preferred embodiment of the present invention these objects are achieved by a method of producing a paper or paperboard product having at least one ply comprising high yield pulp (HYP), said method comprising the steps of:

- providing a furnish comprising at least 50% of high yield pulp (HYP) of a total pulp content in said furnish, said high yield pulp being produced with a wood yield above 85%;
- dewatering the furnish to form a moist web and pressing said moist web to a dry solids content of at least 40-70%; and followed by
- densifying the moist web in a press nip of a paper machine to a density of at least above 600 kg/m$^3$ at a temperature in said press nip above a softening temperature of water-saturated lignin comprised in said high yield pulp to provide a paper or paperboard product containing at least 30% high yield pulp (HYP).

After thermal and/or chemical pretreatments HYP can be manufactured at a wood yield above 85% and at a comparatively low energy input when single fibers are separated from the wood raw material at temperatures around or above the softening temperature of water-saturated lignin as a result of mechanical treatments of chips in disc refiners or logs in wood grinders. By preparing a furnish containing such high yield pulp (HYP) produced with a wood yield above 85%, dewatering the furnish, pressing the formed wet web in a press section to a dry solids content of at least 40-70%, and densifying the web in a press nip of a paper machine to a density of at least above 600 kg/m$^3$ at a temperature above the softening temperature of water-saturated lignin, the produced HYP containing sheets will have the final high ply density, high dry strength and high wet strength (relative wet strength, i.e. (wet tensile index)/(dry tensile index), high Z-directional strength, high tensile stiffness and high compression strength (compression index, SCT).

In a product having only one ply, it is preferred that the content of HYP is at least 50% of a total fiber content in said ply. This means that also the furnish for producing the product has to comprise at least 50% HYP of the total pulp content in the furnish. In a product having more than one ply, it is suitable that the total content of HYP in the product is at least 30%, suitably at least 50%, preferably at least 70%, and most preferred at least 80%. This makes it possible to take advantage of lignin as a bonding agent in the sheet structure to get high dry and wet strength properties, when the water-saturated lignin becomes tacky at temperatures above the softening temperature of lignin. As HYP is less expensive to produce than chemical pulps, as high content of HYP as possible is always an economic advantage.

Suitably, the wood yield of the high yield pulp (HYP) is above 90%. Thereby, it becomes possible to use fiber materials with very high stiffness, which is an advantage in products where a high bending stiffness or compression strength (SCT) is given priority. High yield may also be a more eco-friendly alternative as more products can be produced from a certain quantity of wood and the amount of waste material is minimized.

A suitable temperature for the press nip is above 160° C., preferably above 180° C., and most preferred above 200° C. This makes it possible to take advantage of water-saturated lignin as a bonding agent in the sheet structure to get high dry and wet strength properties. The bonding between fibers increase with increased press nip temperature. As the demands regarding strength in fiber-fiber bonds may be different in various products, the optimum press nip temperature can be changed according to specific requirements.

The high yield pulp is preferably manufactured in a TMP, CTMP, HTCTMP, CMP, SGW or PGW process from softwood or hardwood. This makes it possible to use high yield pulp with different property characteristics. Different characteristics may be preferred in paper or board products depending of desired final product specifications.

In another aspect of a preferred embodiment of the present invention, the above object is achieved in that a paper or paperboard product comprises at least one ply, where at least one ply contains at least 50% high yield pulp (HYP) produced with a wood yield above 85%. Said product is produced in a paper machine by forming a moist web from a furnish including said HYP, pressing said moist web to a dry solids content of at least 40-70% and densifying said moist web in a press nip at a temperature above the softening temperature of water-saturated lignin. This makes it possible to make products with both high dry and wet strength properties, when the lignin becomes tacky at temperatures above the softening temperature of water-saturated lignin. As HYP is less expensive to produce than chemical pulps, a high content of HYP is an economic advantage.

Preferably, the ply comprising at least 50% HYP has a density above 600 kg/m$^3$, a tensile index above 50 kNm/kg, a Scott-Bond value above 500 J/m$^2$ and more preferred above 600 J/m$^2$, a compression index (SCT) above 25 kNm/kg, a tensile stiffness above 6 MNm/kg, and an initial relative wet strength, i.e. (wet tensile index)/(dry tensile index), above 10% without wet strength additives. This makes it possible to manufacture products, like packaging papers, paper bags, liner or fluting, with the same or better properties regarding dry and wet strength and compressibility, at a lower cost than those made from kraft pulps. Following, a paper or board product consisting of only one ply, i.e. said HYP ply, then has the same physical properties as the ply. The HYP content in this product is the same as in the one ply, i.e. at least 50% of the total pulp content in said ply. An example of a one-ply product may be paper bags for groceries.

Suitably, the paper or paperboard product comprising more than one ply, has a tensile index above 60 kNm/kg, a compression index (SCT) above 30 kNm/kg, a tensile stiffness above 7 MNm/kg and an initial relative wet strength, i.e. (wet tensile index)/(dry tensile index), above 15% without wet strength additives. This makes it possible to manufacture products, like packaging papers, paper bags, liner or fluting, with better properties regarding dry and wet strength and compressibility than products made from kraft pulps.

Preferably, and irrespective of the number of plies, the relative wet strength is above 30%, suitably above 40%. This makes it possible to manufacture products, like packaging papers, paper bags, liner or fluting, with considerably better wet strength properties than products made from kraft pulps.

BRIEF DESCRIPTION OF THE DRAWINGS

In the following, the invention will be described in more detail with reference to preferred embodiments and the appended drawing.

MODE(S) FOR CARRYING OUT THE INVENTION

Figure 1:
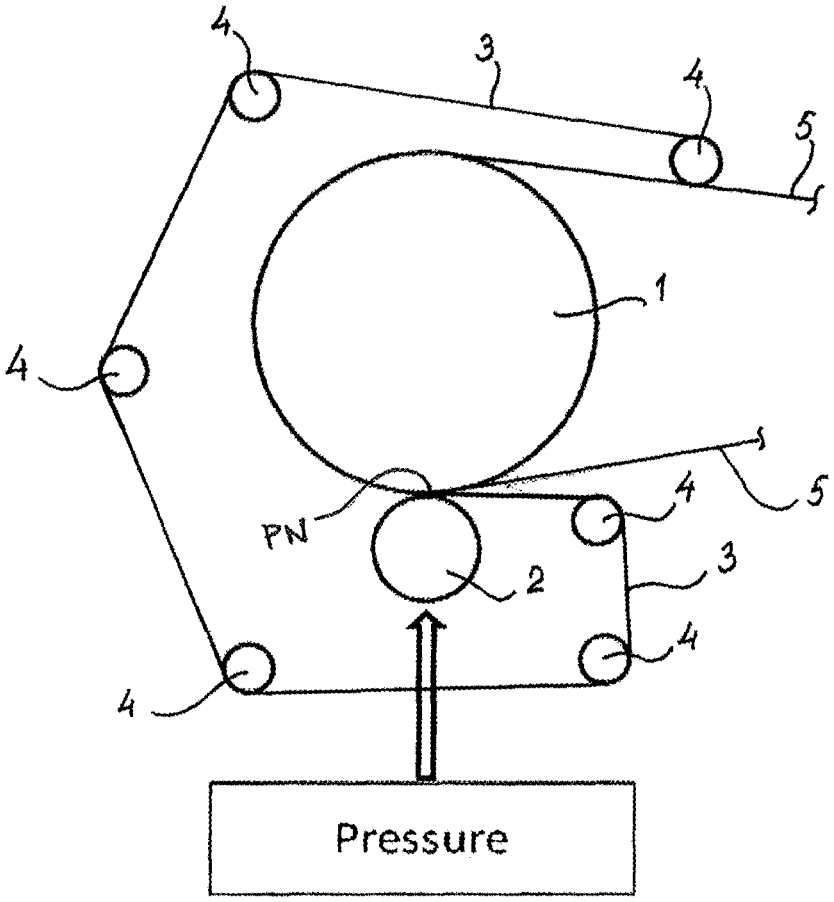
FIG. 1 is a principle sketch showing a hot press in a paper or paperboard machine.

To produce the paper or paperboard product of the invention with the method of the invention, a high yield pulp (HYP) produced with a wood yield above 85% is used to make a furnish, which can be delivered to a forming fabric in a forming section of a paper or paperboard machine and dewatered on the forming fabric to form a moist web. The paper or paperboard machine may have more than one forming fabric for separate forming of different plies from different furnishes in a multi-layer product. It could also be possible to use a multi-layer headbox to deliver different furnishes simultaneously, e.g. one furnish for each ply in a multi-ply product to be produced by the inventive method, to the forming fabric.

Downstream of the forming section is preferably a press section arranged where the moist/wet web while running through the press section is pressed to a dry solids content of 40-70%. In some embodiments, it may be preferred that the moist/wet web is pressed to a dry solids content even higher than 70% in the press section. It is conceivable to press the moist/wet web to a dry solids content of higher than 80% but preferably not higher than 90%. So, pressing the moist/wet web to a dry solids content of at least 40-70% may be preferred, and more preferred of at least 40-80%. In some embodiments, it may be suitable to press the wet web to a dry solids content of 60-80% depending on desired final properties of the paper to be produced. Said press section may be any conventional, known press section. At said interval of dry solids content the lignin comprised in the HYP-fibers is a water-saturated lignin, a so called wet lignin, having a moisture content between approximately 5-15%. The wet web, of which the high yield pulp (HYP) constitutes at least 50% of the at least one ply to be produced, is transferred from the press section to a hot press nip, where the web is densified at a temperature above the softening temperature of water-saturated lignin to provide a paper or paperboard product containing at least 30 wt-% high yield pulp (HYP) of the total pulp content in said product.

It is beneficial that the dry solids content of the dewatered wet web, when entering the (hot) press nip is at least 40% since a too high water content in the web will prevent creation of permanent fiber-fiber bonds. It is further beneficial that the dry solids content of the dewatered wet web, when entering the hot press nip is 70%, or about 70%, at the most. The reason for this is that if the hot nip stage is carried out at a much higher dry content strong permanent fiber-fiber bonds cannot be established. Hence, the dry solids content of the wet web is 40-70% when entering the press nip. However, in some embodiments it may be preferred that the dry solids content of the wet web is higher than 70% when entering the hot press nip, but preferably not higher than 90%. The dry solids content of the web after the hot press nip may be 80% or more.

The hot press nip stage may be placed either upstream of a drying section or as a part of the drying section of the paper or paperboard machine. It is also conceivable that the web after having passed the hot press drying step has reached a final dryness and that no further drying is needed.

FIG. 1 is a principle sketch showing a hot press for press drying according to the invention in a paper or paperboard machine. The hot press comprises a press member and a heated counter member, which together form a press nip PN. In the shown embodiment the counter member is a rotary cylindrical dryer 1 usually internally heated by steam, and the press member is preferably a variable crown press roll 2 that can be pressed against the dryer 1 by any desired force. It is conceivable that also the press roll 2 is heated. Further, the hot press comprises an endless dryer fabric 3 and a plurality of guide rolls 4 to guide the travel of the dryer fabric 3 as it travels through the very press nip PN and around about half of the envelope surface of the cylindrical dryer 1 while pressing the web 5 against the hot dryer surface. The steam that forms by evaporation of water in the web 5 passes through the dryer fabric 3 into surrounding air. The supplied heat and the pressure in the nip PN are adjusted to achieve the desired softening of the lignin, so that the lignin becomes tacky, which results in enhanced fiber-fiber bond strength at both final dry and wet conditions in sheet structures.

The hot press drying on a paper machine can be carried out in all available types of such machine concepts, where the web can be subjected to a temperature above the softening temperature of lignin at a simultaneous sufficient high pressure and dwell time to achieve the desired density according to the invention. At temperatures well above the water-saturated lignin softening temperature, fiber-fiber bonds with very high wet strength are formed between HYP fibers, when the fibers are brought into close contact at conditions according to the invention, as the chemical and physical properties of wood lignin are changed. Thus, the present invention is not restricted to the use of a dryer cylinder and a variable crown press roll. If desired, a shoe press roll may be substituted for the variable crown press roll, and to increase the speed of the hot press or permit an increased thickness of the web, a Yankee dryer may be substituted for the usual dryer cylinder. It would even be possible to substitute a Condebelt drying system or a Boost-Dryer for the usual roll nip hot press. The Condebelt drying system is disclosed in FI-54514 B (Lehtinen), U.S. Pat. No. 4,461,095 (Lehtinen), and U.S. Pat. No. 5,867,919 (Retulainen), for example, and the BoostDryer is disclosed in U.S. Pat. No. 7,294,239 B2 (Lomic et al.).

Thus, the present invention provides a method for the manufacturing of paper or paperboard products from a HYP containing furnish, comprising at least one ply comprising at least 50 wt-% HYP pulp calculated on the total pulp content in said ply, and as will be clarified below, with outstanding paper or paperboard properties regarding dry and wet strength, compression strength (SCT) and tensile stiffness. To reach this goal, the at least one ply of the paper or paperboard product is treated in a hot press drying process in a paper or paperboard machine by subjecting the moist paper web having a dry solids content between 40-70%, or even higher than 70%, i.e. at least 40-70%, to high pressure at a temperature above the softening temperature of water-saturated lignin to get a high initial relative wet strength (i.e. (wet tensile index)/(dry tensile index)) of above 10% or 15%. From this level, the wet strength can be further improved to above 30% or above 40% by adding different kinds of conventional wet strength agents, like wet strength additives or neutral sizing agents. According to the invention, the at least one ply of the paper or paperboard product will be pressed to a density typically above 600 kg/m$^3$, more preferred above 700 kg/m$^3$, even more preferred above 750 kg/m$^3$, and most preferred 800 kg/m$^3$ or above, to reach a tensile index above 50 kNm/kg, 60 kNm/kg or 70 kNm/kg, a Scott bond value above 500 J/m$^2$, preferably above 600 J/m$^2$, a compression index (SCT index) of above 25 kNm/kg or 30 kNm/kg. Dry tensile index, wet tensile index, SCT and tensile stiffness refer to the geometric mean values in the sheet structure. All sheet properties refer to values from tests according to ISO or TAPPI methods, see below. The sheet strength levels can be further improved by adding such dry and wet strength additives to the furnish that work at temperatures above the softening temperatures of lignin in the hot press drying stage.

As mentioned above sheets from HYP that are manufactured in conventional papermaking have usually Scott Bond values below 400 J/m$^2$ even when HYP fibers have been refined to high flexible at very high energy inputs to be a high quality fiber in printing paper grades. However, in manufacturing of sheets from HYP according to the invention much higher Scott Bond values, values well above 500 J/m$^2$, can be achieved even on HYP that has been manufactured at low energy input in refining, which is characterized of a high CSF (above 250 ml), as the paper sheets are compressed at high temperature where the lignin has been transformed to be tacky. In fact, the Z-directional strength is often so high that it is above the limit for detection using a Scott Bond instrument. In pressing of sheets from chemical pulps, which contain just a low content of lignin, at equivalent conditions this enhance in bond strength is not that significant. Even at impulse drying at high temperature of sheets from chemical pulps, the Scott Bond value is remarkable low (see e.g. US 200020062938 A1). To reach high Scott Bond values on chemical pulp sheets at Impulse Drying it therefore seems to be necessary to add polymers and micro- or nanoparticles to the web before the hot pressing stage, i.e. the hot press nip.

Said at least one HYP-containing ply may further comprise pulp or pulps other than HYP. The pulp/-s is/are suitably one or more of chemical pulps, e.g. kraft pulp, sulphite pulp and semi-chemical pulps, e.g. NSSC.

The total content of HYP as compared to a total pulp content in the product to be produced decreases for every added ply not comprising HYP. Therefore, in a product having more than one ply, the total content of HYP in the product should preferably be at least 30 wt-%, suitably at least 50%, preferably at least 70%, and most preferred at least 80% of the total pulp content. This makes it possible to take advantage of the high dry and wet strength properties of HYP containing plies, when the lignin becomes tacky at temperatures above the softening temperature of water-saturated lignin. As HYP is less expensive to produce than chemical pulps, a high content of HYP is usually considered to be an advantage. It is to be understood that in a multi-layer product HYP may be present in more than one of the plies forming the product. The other plies not comprising HYP may typically but not necessarily consist of chemical pulps, e.g. kraft pulp, sulphite pulp, and/or semi-chemical pulps, e.g. NSSC.

A preferred example of a HYP product according to the invention may be a product consisting of three plies; a middle-ply comprising at least 50% HYP, and outer plies comprising chemical pulp. The total content of HYP in the three-layered product is at least 30%. Said outer plies may be formed from one and the same furnish or from different furnishes having different compositions so as to reach the desired final properties of the product. Another preferred example may be a multi-ply product, e.g. a product having three, four, five or six or more plies and comprising a HYP-ply made from a HYP having a high freeness and another HYP-ply made from a HYP having a low freeness. Additional pulp in the respective HYP-layers may be kraft pulp.

In addition, the product may also comprise one or several plies of made of non-cellulosic materials, e.g. plastic, biopolymer or aluminum foils, coatings etc.

Generally, plies comprising chemical pulps have higher densities than HYP-plies. This means that the density of the final product increases for every added ply comprising chemical pulp. A product consisting of only the HYP-ply may as already mentioned have a density above 600 kg/m$^3$, while a two-layer product consisting of a HYP-ply and a ply made of chemical pulp may have a density above 650 kg/m$^3$.

In multi-ply products with high requirements of strength and stiffness, outer plies can be designed to obtain other properties than those given priority in the present invention.

This means that the inventive paper or board product may comprise different kinds of cellulosic fibers from different pulping processes.

Suitably, the wood yield of the high yield pulp (HYP) is above 90%. This makes it possible to use HYP fibers with high stiffness, especially in middle plies, which is an advantage in products with the highest demands on bending stiffness or compression strength (SCT). High yield is also advantageous as more products can be produced from a certain quantity of wood, minimizing the amount of waste material.

The softening temperature of water-saturated lignin during papermaking may be approximately 140-170° C., but can also be higher than 170° C. depending e.g. on softwood or hardwood pulps used, the chemistry in the pulping process, processing conditions in the pulp and papermaking unit, processes like loading rates in press nips of paper-machines etc. Higher loading rates lead to higher softening temperature. A suitable temperature in the press nip may therefore be above 160° C., preferably above 180° C., and most preferred above 200° C. This makes it possible to efficiently take advantage of lignin as a bonding agent in the sheet structure. As the strength in fiber-fiber bonds increases with increased press nip temperature, different demands regarding strength can be met by changing press nip temperature. Paper-machines are most often operated at very high machine speeds which means that the dwell time of the wet paper or board web in the press nip is very short and that the web passes through the press nip very quickly. It may thus be advantageous if the temperature in the press nip is well over the softening temperature of the water-saturated lignin so as to assure that the lignin in the fibers of the web may reach the softening temperature during the short dwell time in the nip. However, a high temperature requires more energy. Hence, a temperature above 200° C. is preferred. Suitably, a temperature lower than 260° C., more preferred 240° C. or lower, and most preferred 230° C. or lower, may be a preferred temperature in the hot press nip. In some embodiments, a suitable temperature in the press nip may be in the interval of 205-225° C. The examples presented below are performed in a pilot machine operated at a lower machine speed (i.e.) than ordinary mill paper machines. Therefore, the dwell time in the press nip of the pilot machine is longer and there is more time for the wet web to be heated in the pilot press nip, whereby the press nip temperatures in the examples are limit to 200° C. and not above 200° C. Due to the longer dwell time in the pilot press nip, it is ascertained that the water-saturated lignin in the wet web will reach a temperature above the softening temperature of the wet lignin already at a temperature of about 200° C. For multi-ply products comprising several plies it may be beneficial to perform the press nip at a temperature well above 200° C., e.g. 210-240° C., due to the many layers that have to be heated.

At hot pressing at temperatures well above 100° C. on a paper machine water is removed from the paper web in the hot press by the combined action of mechanical pressure and intense heat. This is utilized at drying according to impulse drying technique (Arenander, S. and Wahren, D. (1983): Impulse drying adds new dimension to water removal, TAPPI Journal 66(9), 24-32). In impulse drying the paper web is fed into a hot press nip at a dry content around 40%. The press temperature is usually very high, i.e. 200-350° C. A serious problem connected to the impulse drying technique of webs from beaten chemical pulps is that delamination of the paper structure easily occurs, when superheated water flashes into steam after the hot press nip. Many attempts have been tested to overcome the problem (see e.g. US2002/0062938 A1). One way to reduce this undesired effect of hot pressing is to feed the paper web at as high dry content as possible into the hot press nip as less steam is produced at such conditions. However, according to the present innovation the problem with delamination is complete eliminated when a web containing a high content of high freeness HYP is fed at high dry content into the hot press. Webs with a high content of high freeness HYP are characterized of a more open structure than webs with a high content of beaten chemical pulps, which means that steam from the hot press can be more easily evacuated through the HYP containing web structure. Freeness (Canadian Standard Freeness, CSF) is a measure of the dewatering rate under specific conditions of a pulp web. In manufacturing of a HYP with a high CSF value the energy input in refining or grinding is reduced. Generally, a web structure containing a certain amount of HYP with a high CSF value gets more open than a corresponding web containing HYP with a low CSF value. To avoid delamination of the paper structure at hot pressing at temperatures above the softening temperatures of water-saturated lignin in a web containing at least 50% high freeness HYP, the CSF value for the HYP should be above 250 ml, preferably above 400 ml and most preferably above 600 ml. As the energy consumption at manufacturing of HYP is reduced when the value of CSF increases it is of course advantageous to use a HYP of as high CSF level as possible providing that expected paper properties are reached.

It is also preferred that the high yield pulp is manufactured in a TMP, CTMP, HTCTMP, CMP, SGW or PGW process from softwood or hardwood. This makes it possible to use the specific property profile of different HYP qualities. Different characteristics may be preferred according to desired final product specifications, e.g. different densities, strength levels.

EXAMPLE

Press Drying of Spruce CTMP Containing Sheets at Temperatures Below and Above the Softening Temperature of Water-Saturated Lignin A press-drying trial was performed in the pilot plant shown schematically in FIG. 1. Laboratory sheets 5 at 40% dry content, manufactured in a Rapid Köthen sheet former (ISO/DIS 5269-2) were fed into the nip between a heated cylinder 1 and a press roll 2. Sheets containing spruce CTMP with two different Canadian Standard freeness (CSF) levels, 420 and 720 ml respectively, were tested. These pulps can be manufactured at a low input of electric energy in refining, i.e. below 1200 kWh/ton. Sheets from a standard bleached kraft pulp were used as reference. In some trials the CTMP fiber materials were surface modificated with a low dosage of cationic starch. Cylinder and press nip temperature was varied between 25 and 200° C. The same nip pressure was applied in all trial points.

Preparation of Pulps for the Trial

A special low energy, high freeness (CSF 720 ml) HTCTMP from spruce (600 kWh/adt in refining stages including reject refining) was manufactured in a mill trial at the SCA Östrand CTMP mill in Timrå, Sweden. In the mill the impregnation vessel is situated inside the preheater, and chips are atmospherically steamed before impregnation with 15-20 kg $Na_2SO_3$ at pH 10. Preheating temperature was about 170° C. The turbine refiner plates used in the main refiner were of the feeding type. The pulp was peroxide bleached and flash dried. A standard type of bleached and flash dried CTMP (CSF 420 ml) from the same mill was also tested. In the manufacturing of that pulp, the energy consumption in refining was 1200 kWh/adt.

A standard market bleached softwood kraft pulp, also from the SCA Östrand mill, was tested as a reference pulp. The chemical pulp was laboratory beaten to 25 SR.

Before fiber preparation, (HT)CTMP was hot disintegrated according to SCAN M10:77 and the bleached softwood kraft pulp was reslushed according to SCAN C: 1865.

Some (HT)CTMP and CTMP fibers were treated with a lower dosage of cationic starch (25 mg/g).

Fiber Surface Preparation with Cationic Starch

Potato starch, CS, supplied by Lyckeby Stärkelsen, Sweden, with a cationic degree of substitution of 0.040, was used. The starch was laboratory cooked by heating a 5 g/l starch slurry to 95° C., maintaining this temperature for 30 min, and allowing the starch solution to cool down under ambient conditions. Fresh solutions of starch were prepared each day in order to avoid the influence of starch degradation.

Sheet Preparation to 40% d.c. in Laboratory

Sheets were made on a Rapid Köthen sheet former from Paper Testing Instruments (PTI), (ISO 5269-2) Pettenbach, Austria. Sheets with a grammage of 150 g/m$^2$ were formed after vigorous aeration of the fiber suspension just before sheet preparation. The sheets were then press-dried at 100 kPa and dried under restrained conditions at 94° C. until reaching a dryness content of 40%.

Press Drying Equipment

The moist sheets were inserted into the dryer fabric 3 between a press roll 2 and a heated dryer cylinder 1 of the pilot press drying machine. The diameter of the cylinder 1 and the press roll 2 was 0.8 m and 0.2 m, respectively. The feeding rate was 1 m/min. The nip pressure was on a high level, which was selected to give sheets with high densities. The cylinder temperature was varied between 20-200° C. The press nip duration was about one second. The sheets, pressed at 20° C., were fed into the dryer a second time at a cylinder temperature of 100° C. without applied press load for final drying of the sheets. The sheets that were pressed and dried at 100-200° C. reached full dryness during the first loop.

Sheet Testing

After conditioning (ISO 187) tensile testing index and tensile stiffness index were measured according to ISO 5270/1924-3, SCT was measured according to ISO 9895, wet strength index was measured according to SCAN-P 20:95, soaking time 1 minute. Grammage, thickness and density were evaluated according to ISO 536 respectively 534. Scott Bond is measured according to Tappi T 569.

Pulp Testing

Freeness (CSF) is measured according to ISO 5267-1,2.

Results

In the current trial, sheets from a medium freeness (420 ml) CTMP and a high freeness (720 ml) HTCTMP were pressed in the hot press nip at temperatures both below and above the softening temperature of water-saturated lignin. The effects on sheet properties were compared with those on a beaten bleached kraft pulp. Furthermore, the effect of surface modification of HTCTMP and CTMP fibers with just a low dosage of cationic starch were evaluated.

Figure 2A:
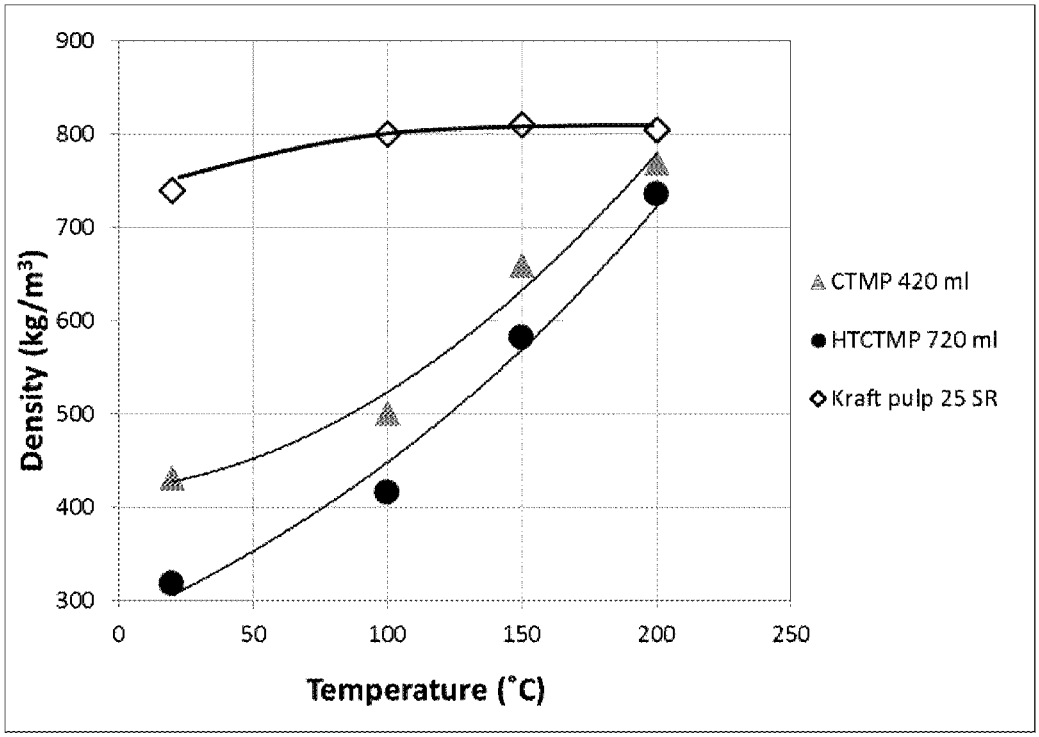
FIG. 2*a* is a diagram showing the variation in ply density with various press temperatures at pressing of furnishes of high yield pulps (HYPs).

The densification effect of sheet structures as a result of increased press nip temperature is shown in FIG. 2. The effect is most evident for sheets containing untreated HT CTMP and CTMP fibers, whereas sheets from the kraft pulp are more or less unaffected by press temperature, see FIG. 2*a*. The relative increase in density is the greatest on sheets from the high freeness HT CTMP, where density is more than doubled when the press nip temperature is increased from 25 to 200° C. A sheet density close to that of the kraft pulp sheets is obtained at a press temperature of 200° C., i.e. at a temperature well above the softening temperature of water-saturated lignin. Obviously, enhanced softening of the HYP fibers enables bringing the fiber material in close contact, and very strong permanent bonds are created at pressure at temperatures well above the softening temperature of water-saturated lignin at an appropriate moisture content. If the press and drying stage is carried out in a too low dry content range, compressed stiff HYP fibers easily spring back to their original shapes when the pressure is released since creation of permanent fiber-fiber bonds are prevented by water between fiber surfaces in the paper sheet. However, as stated above, if the dry content is too high, i.e.

above the wet saturation point of the fiber material, strong permanent fiber-fiber bonds are not established in any wood fiber based paper structures.

Figure 2B:
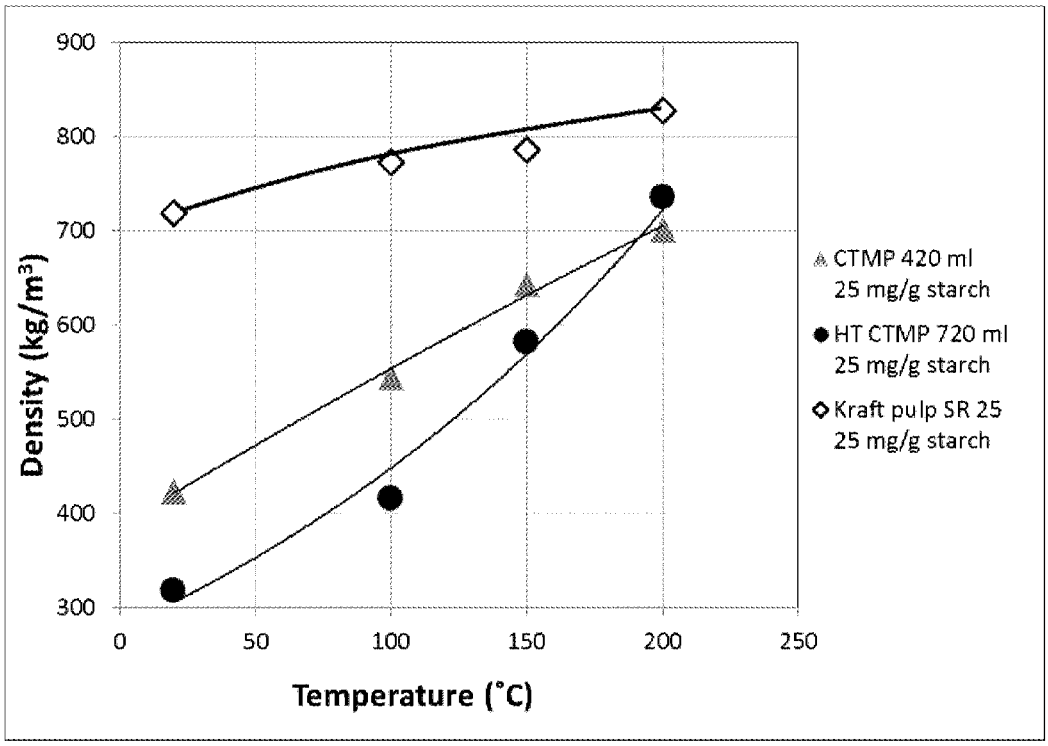
FIG. 2*b* is a diagram similar to FIG. 2*a* but with starch added to the HYPs.

After fiber surface modification with cationic starch the densification effect is very similar to that without fiber surface treatments, see FIG. 2*b*.

Figure 3A:
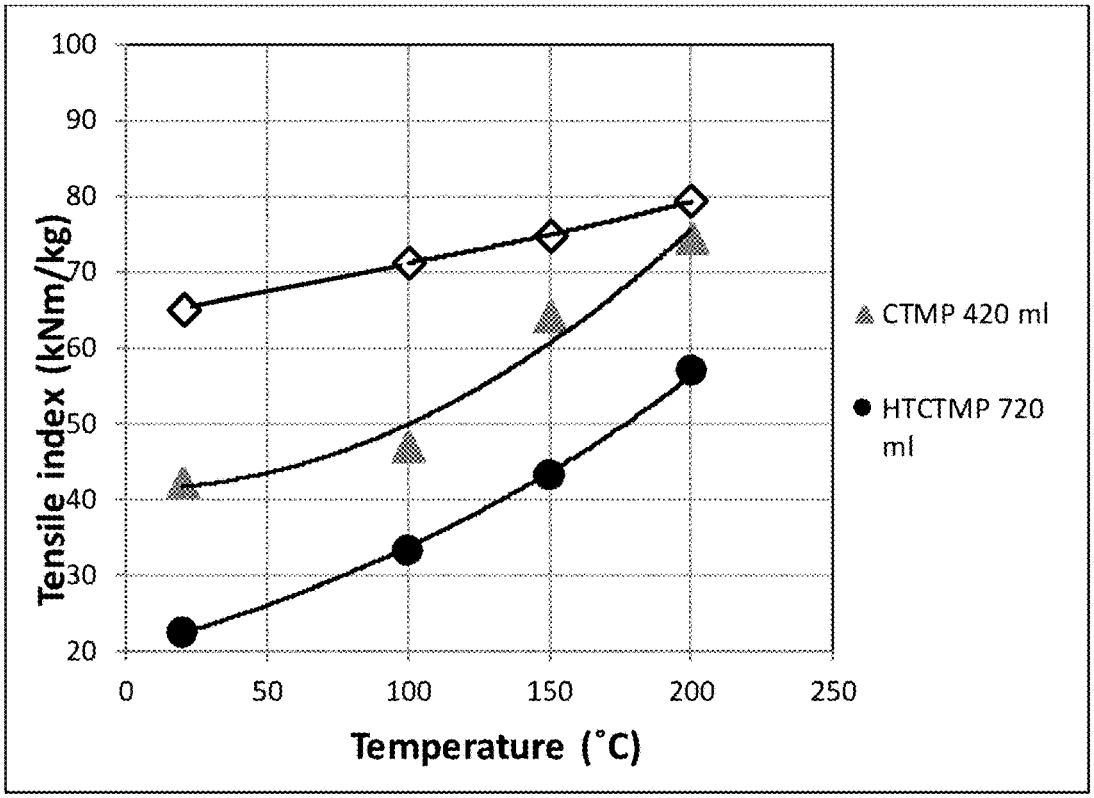
FIG. 3*a* is a diagram showing the variation in ply tensile index with various press temperatures at pressing of furnishes of HYPs.
Figure 3B:
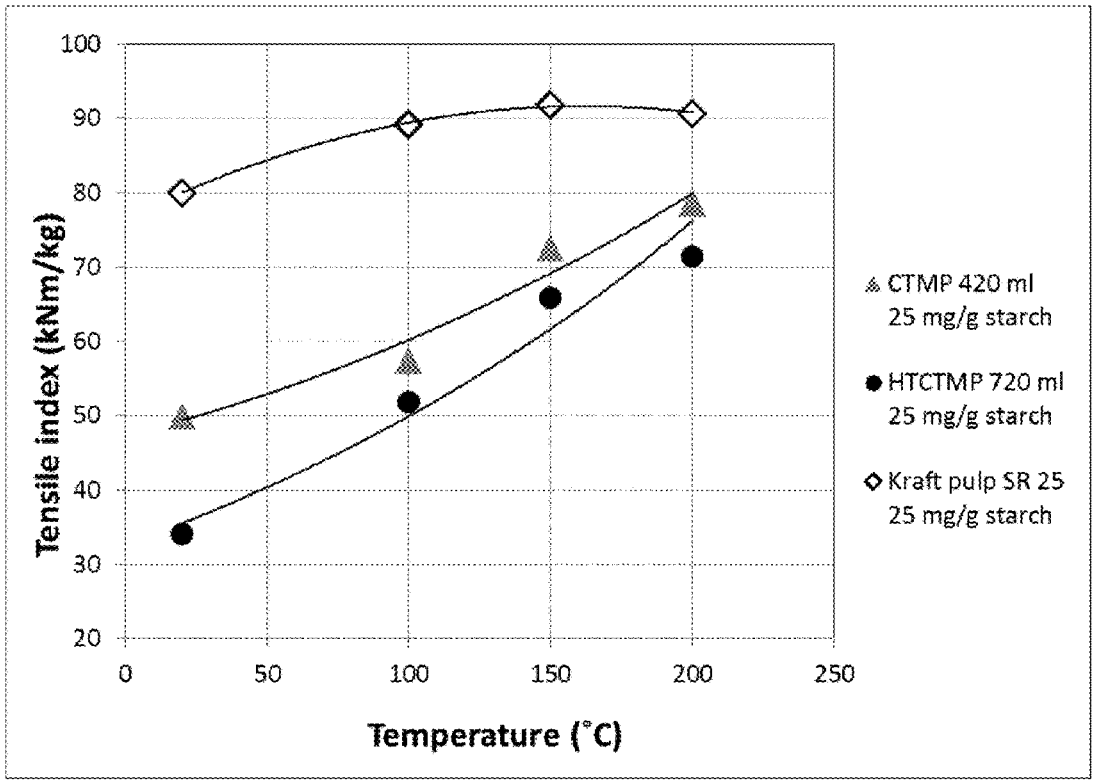
FIG. 3*b* is a diagram similar to FIG. 3*a* but with starch added to the HYPs.

With increased density, which is a result of enhanced temperature in pressing and drying, the tensile index of HYP sheets is substantially improved, whereas the tensile index of the kraft pulp sheets is just marginally changed, see FIG. 3*a*. Sheets from CTMP (CSF 420 ml) and HTCMP (CSF 720 ml), where the fibers have been surface treated with cationic starch, reach tensile index at more or less the same level as the untreated reference kraft pulp at the highest press temperature, see FIG. 3*b*. The bond strength in the lignin rich sheet structure is very high and clearly related to the enhanced temperature which resulted in the moist lignin becoming tacky. As the number of fibers in a HTCTMP web is only about half of that in a kraft pulp sheet, due to the difference in pulp yields, the strength of fiber-fiber bonds between lignin rich HTCTMP fiber surfaces in close contact could be higher than in a kraft pulp structure.

Figure 4A:
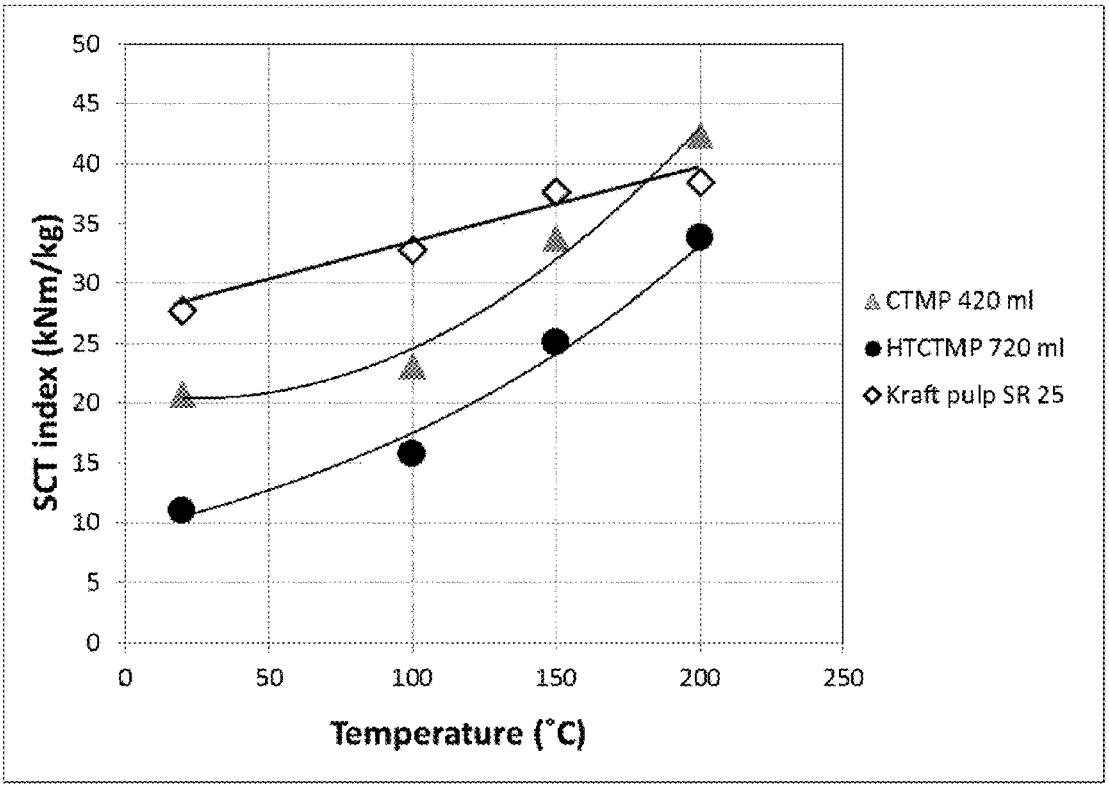
FIG. 4*a* is a diagram showing the variation in ply SCT index with various press temperatures at pressing of furnishes of high yield pulps (HYPs).
Figure 4B:
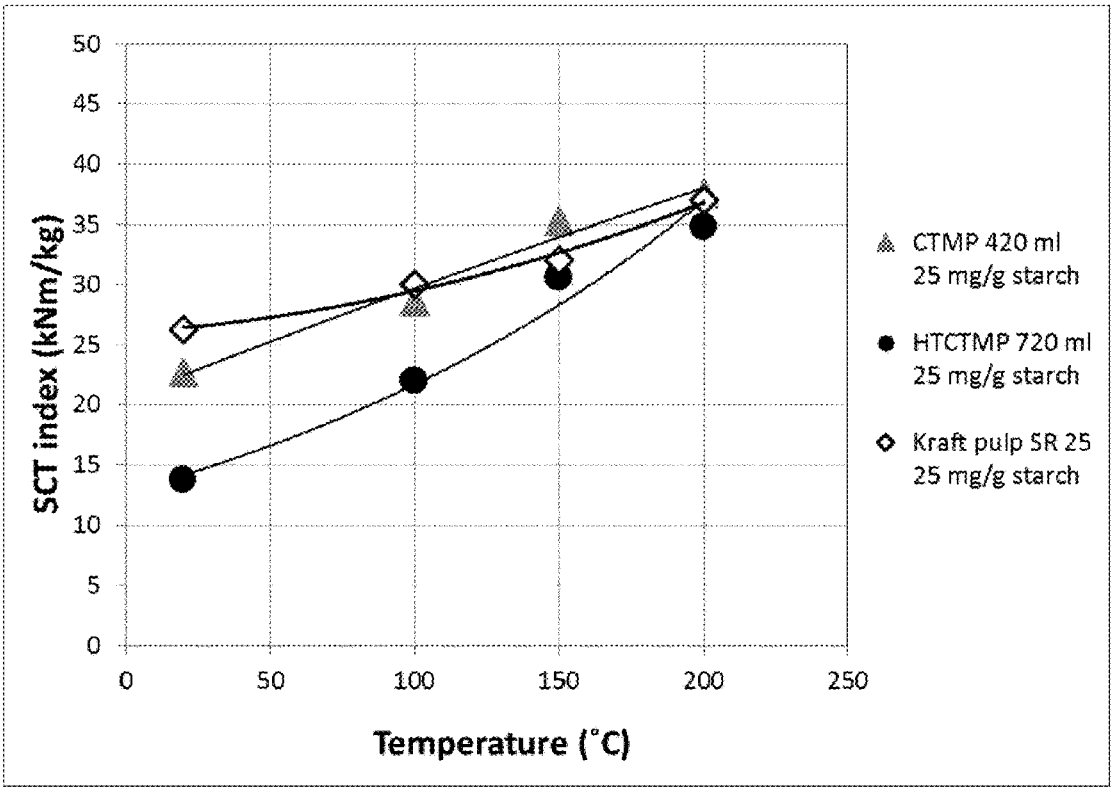
FIG. 4*b* is a diagram similar to FIG. 4*a* but with starch added to the HYPs.

The best compression strengths of CTMP as well as HTCTMP sheets, which have been pressed at the highest temperature (200° C.), measured as SCT index (kNm/kg), is on the same level as the reference sheets from the kraft pulp, see FIG. 4*a*. This could be expected as the density and tensile index of HYP sheets are quite similar to the kraft pulp reference sheets, compression index (SCT) for HYP sheets should be as high as or higher than the kraft pulp sheets as the HYP fibers are much stiffer. At surface treatment with cationic starch, the SCT values of sheets from high freeness (720 ml) HTCTMP are improved somewhat, see FIG. 4*b*. The sheets from CTMP, which has a lower freeness value, are less affected, compare FIGS. 4*a* and 4*b*.

Figure 5A:
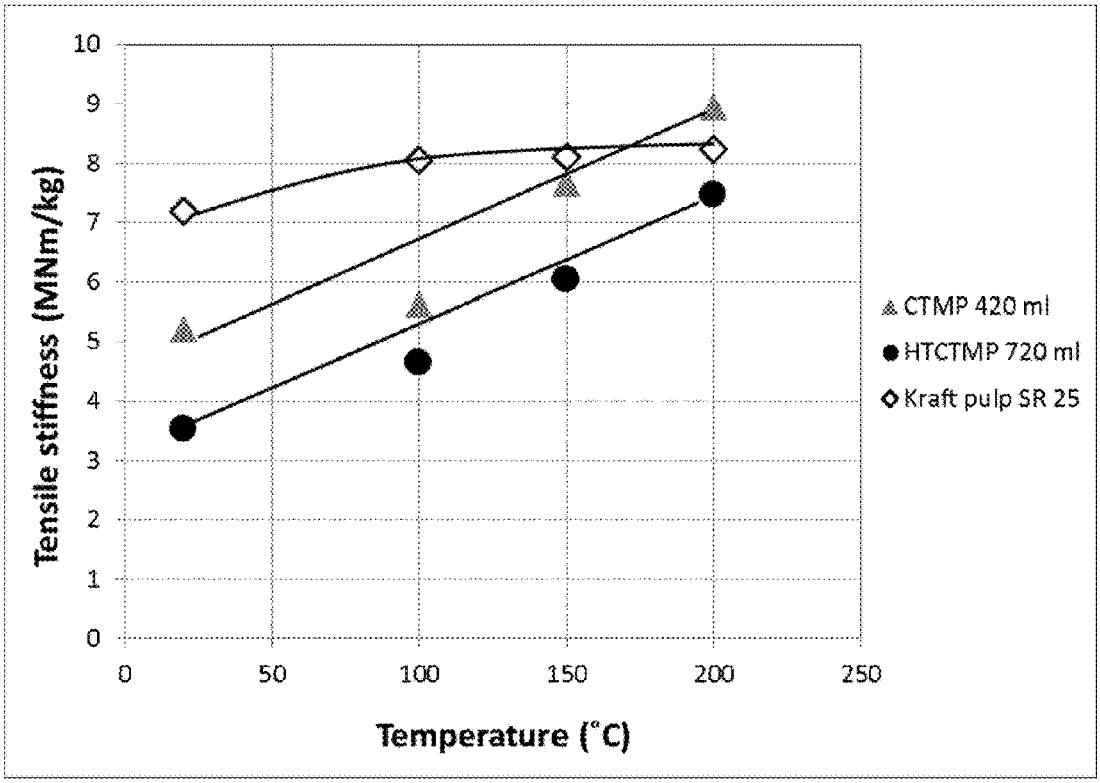
FIG. 5*a* is a diagram showing the variation in ply tensile stiffness with various press temperatures at pressing of furnishes of high yield pulps (HYPs).
Figure 5B:
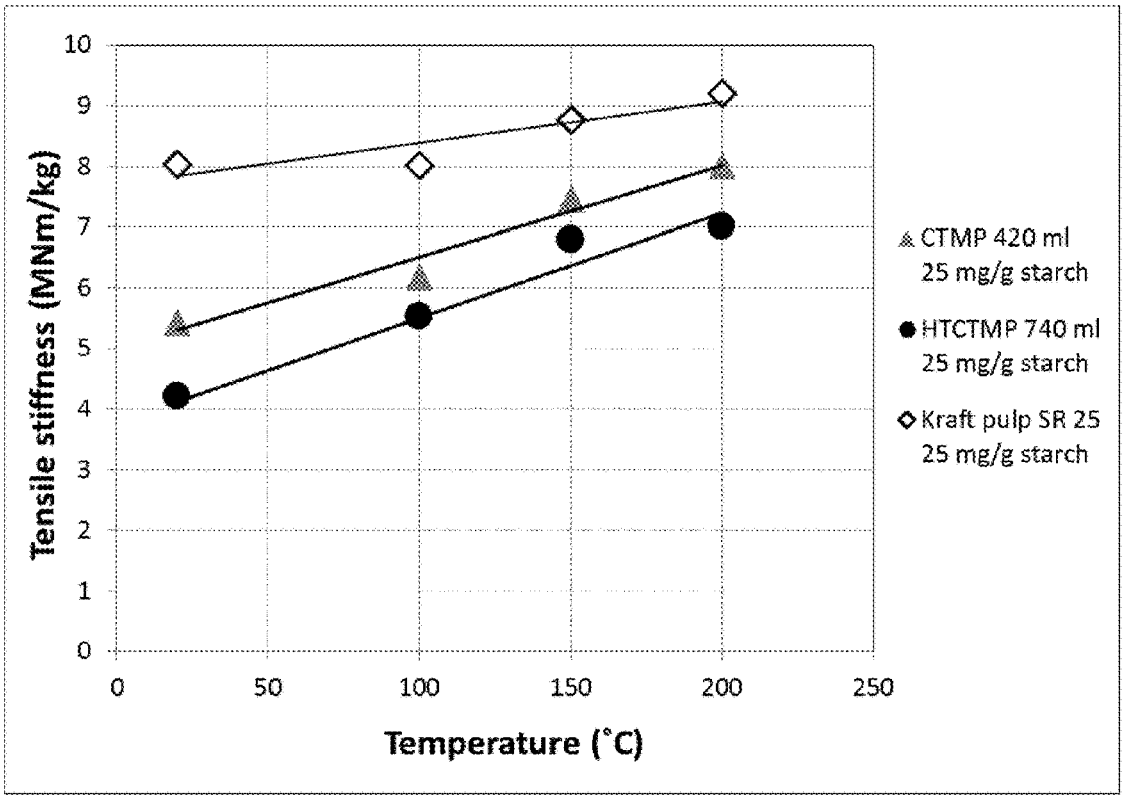
FIG. 5*b* is a diagram similar to FIG. 5*a* but with starch added to the HYPs.

The development of tensile stiffness for the HYP sheets with increased press temperature follows almost the same pattern as tensile index and compression strength, see FIG. 5. It is obvious that it is possible to reach the same level with HYP sheets as on reference sheets from the kraft pulp, see FIG. 5*a*. Surface treatment with cationic starch seem not to improve tensile stiffness, compare FIGS. 5*a* and 5*b*.

Figure 6:
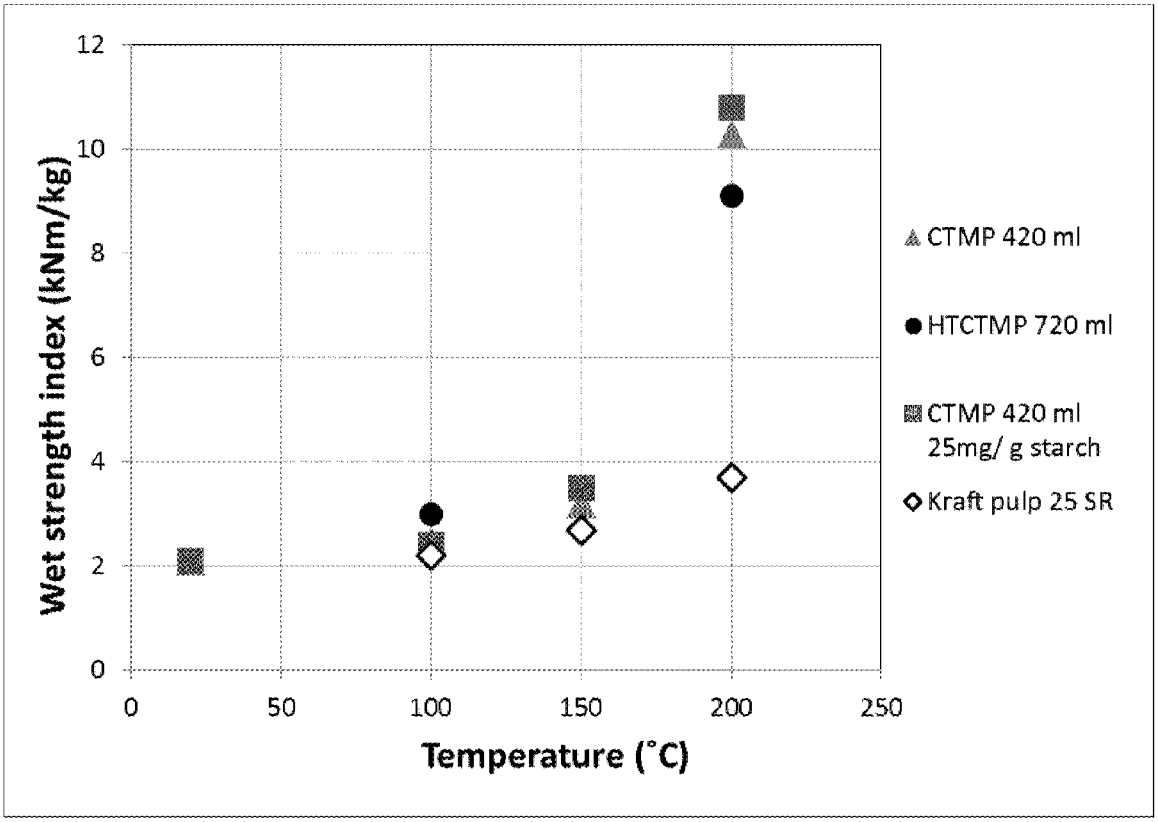
FIG. 6 is a diagram showing the variation in ply wet strength index with various press temperatures at pressing of furnishes of HYPs with and without addition of starch.

The initial relative wet strength (i.e. (wet tensile index)/(dry tensile index)) of the CTMP containing sheets increases considerably, when the temperature enhances to well above the softening temperature of water-saturated lignin (200° C.), i.e. at a temperature where the lignin becomes very tacky, see FIG. 6. At the highest temperature in the trial the relative wet strength is more than twice as high on sheets from CTMP and HTCTMP fibers than on sheets from the reference kraft pulp.

FINAL REMARKS

The results in the example show that it is possible to manufacture sheets from HYP, which has been manufactured with a low input of electric energy in refining, i.e. below 1200 kWh/adt, with tensile index, compression index (SCT) and tensile stiffness index at the same or almost the same level as sheets from a bleach softwood kraft pulp, when papermaking conditions are changed to better suit the characteristics of lignin rich HYP fibers, i.e. at press temperatures above the softening temperature of water-saturated lignin. It is evident that HYP webs are consolidated to a stable structure at high press loads in a dry content interval above 40%, and at temperatures above the softening temperature of water-saturated lignin. Under such papermaking conditions even HYP like HTCTMP, which can be manufactured at very low electric energy consumption in refining, could be used in the manufacturing of paper products with high strength requirements, e.g. packaging papers, paper bags, liner or fluting. In this study, press temperatures of up to 200° C. were tested, which is a temperature well above the softening temperature of water-saturated lignin. The results indicate that sheet properties may be further improved if even higher temperatures are used. The results show that this is an as of yet unexploited potential of HYP, which could be used to manufacture paper products where strength requirements are very high if the processing conditions according to the invention are used. Sheet characteristics from HYP webs can be changed within a broad range by changing the press temperature in papermaking, as the physical and chemical properties of lignin are marked differently at different temperatures. It is evident that high density and strong sheets from HYP webs can be formed in a cost-efficient way in papermaking if the moist web is pressed at conditions where the water-saturated lignin is softened to temperatures above the softening temperatures of water-saturated lignin.

In products having more than one ply it is conceivable that high yield pulp may be present in two or more plies depending on the desired final product characteristics. The inventive method and product are further not restricted to the number of HYP-containing plies and in which sequence the plies are arranged in the product, neither to the total number of plies in the product. The number of plies and their mutual placings depend on the desired characteristics of the final product and may hence vary. A product having two or three plies of HYP and one or two plies of chemical pulp and a coating on at least one of the two outer sides may e.g. be conceivable.

The percentages presented are, where applicable, weight percentages and not volume percentages.

The production line for producing the inventive product according to the inventive method may comprise equipment not mentioned above or shown in FIG. 1, e.g. a conventional press section and further drying equipment. It is further conceivable that the web has reached final dryness after the hot press drying step and that no final drying is needed after the hot press drying step. Moreover, in some embodiments it may be beneficial to place the hot press drying step as a step comprised in the drying section of the machine. The wet web leaving the press section and entering the drying section may first be dried in a conventional manner in the drying section and to a dry solid contents of at least 50-70%. Said web may then enter the hot press nip and be press dried in accordance with the inventive method. Said hot press drying may be performed either to final dryness or to a higher dry solids content and thereafter, downstream of the press nip, dried to final dryness, e.g. on a drying cylinder.

It is further conceivable to use two or several hot press nips instead of one single hot press nip. Depending on the desired final properties of the product to be produced it may be an advantage of using two or several hot press nips. The dwell time in each press nip may be shorter when using two or several hot press nips as compared to the needed dwell time in one single hot press nip.

The inventive method may further be advantageous to use when producing products made of high yield unbleached chemical pulps still comprising some lignin, e.g. kraft liner products, or recycled fiber furnishes with a high content of lignin.

INDUSTRIAL APPLICABILITY

The invention is applicable primarily in the production of paper and paperboard grades, where strength requirements are high or very high.

The invention claimed is:

1. A method of producing a paper or paperboard product having at least one ply comprising high yield pulp (HYP), comprising the steps of:

providing a furnish comprising at least 50% of high yield pulp (HYP) of a total pulp content in said furnish, said high yield pulp being produced with a wood yield above 85%;

dewatering the furnish to form a moist web, pressing said moist web and drying said moist web to a dry solids content of at least 50-70%;

densifying the moist web to a density above 600 kg/m$^3$ in a single press nip of a paper machine at a temperature above a softening temperature of water-saturated lignin comprised in said high yield pulp to provide a paper or paperboard product, containing at least 30% high yield pulp (HYP) of a total pulp content of said product, wherein the temperature in the single press nip is in a range between 160° C. and up to 216° C., and a press nip dwell time is about one second; and drying the web to a final dryness after the densifying step.

2. A method as claimed in claim 1, wherein the content of high yield pulp in said at least one ply is between 60-80% of the total pulp content of said ply.

3. A method of claim 1, wherein the wood yield of the high yield pulp (HYP) is above 90%.

4. A method of claim 1, wherein the high yield pulp is manufactured in process selected from group consisting of a TMP, CTMP, CMP, HTCTMP, SGW and PGW from softwood or hardwood.

5. A method of claim 1, wherein said method further comprises addition of at least one ply comprising chemical pulp and/or semi-chemical pulp to said at least one ply comprising HYP.

6. A method of claim 1, wherein said high yield pulp has a freeness (CSF) value above 250 ml.

7. A method as claimed in claim 1, wherein a temperature of water-saturated lignin in the HYP is raised to a temperature where the water-saturated lignin becomes tacky.

8. A method as claimed in claim 7, wherein the relative wet strength is more than twice as high from chemi-thermomechanical wood pulping processes than on ply a kraft pulp.

9. A method of claim 1, wherein the temperature in the single press nip is lower than 200° C.

10. A paper or paperboard product having at least one ply comprising high yield pulp (HYP), wherein the content of high yield pulp is at least 30 wt-% of a total pulp content of said product, and wherein said at least one ply has a density above 600 kg/m$^3$, a tensile index above 50 kNm/kg, a compression index (SCT) above 25 kNm/kg, a tensile stiffness above 6 MNm/kg, and an initial relative wet strength (wet tensile index)/(dry tensile index) above 10% without wet strength additives or neutral sizing agents.

11. A product as claimed in claim 10, wherein the wood yield of the high yield pulp (HYP) is above 90%.

12. A product of claim 10, wherein the high yield pulp is manufactured in a process selected from group consisting of TMP, CTMP, CMP, HTCTMP, SGW and PGW process from softwood or hardwood, and wherein the content of high yield pulp is suitably at least 50% of a total pulp content in said product.

13. A product of claim 10, wherein said at least one ply has a density above 700 kg/m$^3$, having a tensile index above 60 kNm/kg, a compression index (SCT) above 30 kNm/kg, a tensile stiffness above 7 MNm/kg, and an initial relative wet strength (wet tensile index)/(dry tensile index) above 15% without wet strength additives or neutral sizing agents.

14. A product of claim 13, wherein the relative wet strength is above 30%.

15. A product of claim 10, wherein said product further comprises at least one ply made of chemical and/or semi-chemical pulp.

16. A product of claim 10, wherein said product has a Scott Bond value of above 500 J/m$^2$.

* * * * *